United States Patent [19]

McCabe et al.

[11] 4,074,735

[45] Feb. 21, 1978

[54] GROUTING TUBE

[75] Inventors: William E. McCabe; Howard W. McCabe; Edwin L. McCabe, all of Idaho Falls, Idaho

[73] Assignee: McCabe Brothers Drilling, Inc., Idaho Falls, Idaho

[21] Appl. No.: 722,261

[22] Filed: Sept. 10, 1976

[51] Int. Cl.[2] ..... B65B 3/04

[52] U.S. Cl. ..... 141/311 R; 61/36 R; 61/63; 141/392; 166/277

[58] Field of Search ..... 61/35, 36 R, 53.64, 61/63; 141/1, 311 R, 392; 166/277, 301

[56] References Cited

U.S. PATENT DOCUMENTS

| | | | |
|---|---|---|---|
| 3,557,563 | 1/1971 | Stevens | 61/63 |
| 3,949,561 | 4/1976 | Chapman | 61/63 X |
| 3,986,536 | 10/1976 | Janson | 141/392 X |

*Primary Examiner*—Richard E. Aegerter
*Assistant Examiner*—Frederick R. Schmidt
*Attorney, Agent, or Firm*—K. S. Cornaby

[57] ABSTRACT

This invention relates to a grouting tube for packer designed to prevent back-flow of cement grouting material past the grout packer out of the grouting area. The grouting tube is comprised essentially of an inner-tube constructed of steel or like material through which the grouting material is designed to flow. The inner tube has threaded nut means disposed a distance from the upper end of the tube on reverse threads. At the other or lower end of the tube, a retaining ring means is disposed and attached to said bottom end by means of rivets or the like. Concentric with said inner tube and disposed between said ring and said nut means is a series of alternating frusto-conical tubes and flexible frusto-conical leather caps. The caps are designed to act as seals between the grouting tube and the walls of the grout hole to prevent backflow of grouting material. A third concentric tube is disposed about the series of leather caps and frusto-conical tubes to protect the caps and tubes during insertion of the grouting tube into the grout hole. Once in the hole, the external third tube is blown away by water, air, or other means, so that the leather caps can provide the sealing means with the grout hole.

5 Claims, 3 Drawing Figures

GROUTING TUBE

BACKGROUND OF THE INVENTION

State of the Art

One of the major problems encountered in the injection of grouting material, such as cement slurry, into grout holes for sealing foundation areas for earthen-filled dams and the like is that of preventing the back-flow of the grouting material from the grouting area up the grout hole past the grouting packer or tube. Many attempts have been made as evidenced in the prior art to provide adequate means for sealing off the grout packer with the surrounding grout hole walls. None of the prior art disclosures have proved to be efficient or effective in providing the sealing means desired.

A second major problem which is encountered in the grouting field is that of removing the grout packer from the grout hole after the grouting has been completed. Typically, the rotating removal of the grout packer tool is hindered by the rough walls of the grout hole. The grout hole typically has sharp projections and edges which extend from the walls into the hole. Very often during removal of the grouting tube, the grout packer becomes lodged against one or more such projections. In addition, during grouting, the grout packer can become surrounded by cement and become grouted in place.

In the past there has been no alternative to disengaging the grout packer from the tubing above, and leaving the grout packer in the grout hole while withdrawing the remaining tubing from the hole. Unfortunately, when it becomes necessary to re-drill the grout hole beyond the grouting area to a lower level, the drill bit encounters the grout packer lodged in the hole and is able to drill through the steel components of the packer only with great difficulty.

Objectives

It is an objective of this invention to provide a grout packer or tube which can effectively seal the walls of a grout hole and prevent back-flow of grouting material upwardly through the grout hole past the grout packer.

It is a further objective of this invention to provide a grout packer which can release portions of the packer which become lodged in the grout hole during removal of the packer therefrom.

It is also an objective of this invention to provide a grout packer which has component parts that may be left in the grout hole and will not hinder further drilling with conventional drill bits.

It is a further objective of this invention to provide a grout packer which can leave component parts thereof in a grout hole and remove the steel inner mandrel or tube from the hole.

SUMMARY OF THE INVENTION

The grouting tube or packer of this invention has an inner tube, preferably constructed of steel or the like, which has a threaded nut disposed about a threaded portion of the inner tube a distance from the upper end thereof. The lower portion of said inner tube from the nut means downwardly to the other end is of similar diameter than the upper portion of said tube. The nut means is reverse threaded on the inner tube. The lower end of said tube has a retaining ring means adapted to be attached to said lower end by appropriate means, such as pop rivets or the like, which can be broken away upon application of a predetermined amount of pressure on said retaining ring means.

Concentric about said inner tube and disposed between the nut means and the retaining ring means is a series of alternating frusto-conical ridgid tubes and annular leather caps of frusto-conical shape. The leather caps are reversed and extend downwardly to form the seal with the grout hole walls when the grout packer is in place within the grout hole. The rigid frusto-connical tubes interspersed with the leather caps are designed to function as spacers for the caps. Both caps and frusto-connical tubes at their smallest dimension fit snugly about the external circumference of the previously described inner tube.

For ease in inserting the grout packer into the grout hole, a third tube of rigid drillable material is extended concentrically over the leather caps and frusto-connical tubes of the grout packer. After the tube has been inserted in the grout hole, the external sheathing tube is removed by means of water pressure or air pressure from the grout packer to enable the leather caps to extend outwardly from the tube to engage the grout hole walls.

An important feature of the invention is connected with the removal of the grout packer from the grout hole following completion of the grouting. To prevent losing the entire grout packer due to binding of the packer in projections from the grout hole walls, the invention is provided with means for removing the external leather caps, nut means, and frusto-connical tubes from the inner steel mandrel to permit the mandrel itself to be withdrawn from the grout hole. As the nut means engages a projection from the grout hole wall and lodges fast, the rotating of the mandrel in the right handed direction removes the left handed nut means from the lower part of the threaded surface of the inner mandrel tube. As the pressure mounts on the lower retaining ring, the pop rivets break releasing the entire arrangement of leather caps and frusto-connical tubes, permitting the inner mandrel tube to be withdrawn from the hole free of any obstructions.

THE DRAWING

The best mode presently contemplated for carrying out the invention is illustrated in the attached drawings in which.

DESCRIPTION OF THE ILLUSTRATED EMBODIMENT

Figure 3:
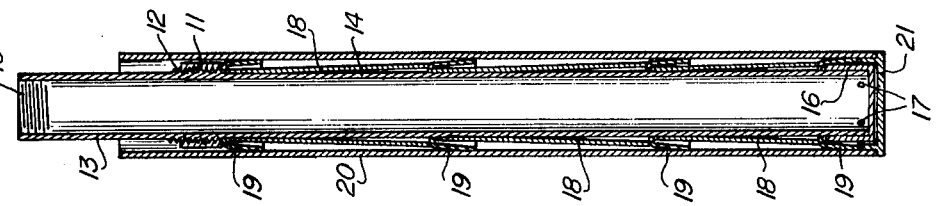
FIG. 3, a vertical elevational section taken along line 3-3 of FIG. 1, showing the arrangement of the three component tubes concentrically within one another.
Figure 2:
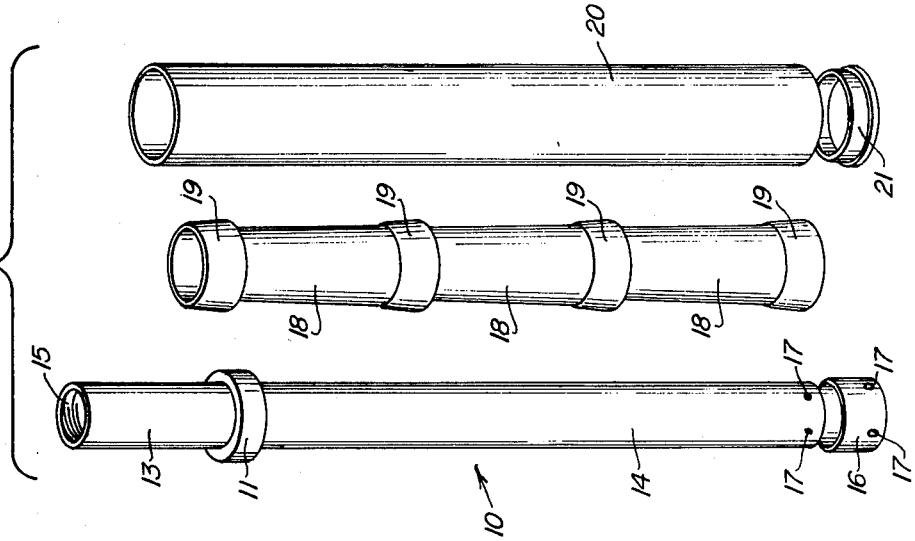
FIG. 2 shows a separation of the grouting tube into its three component tubes, the inner tube on the left, the frusto-conical and leather cups in the center, and the surrounding sheath on the right.
Figure 1:
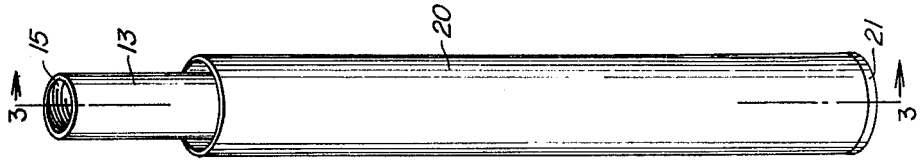
FIG. 1 is a perspective view of the grouting tube with surrounding sheath.

As illustrated in FIGS. 1, 2 and 3, a preferred embodiment of the invention includes three concentric tube arrangements. The inner tube 10 or mandrel as it is commonly known is constructed of steel preferably, since tube 10 carries the flow of grout and is recoverable from the grouting hole for repeated use.

Tube 10 has a nut 11 a short distance from the upper end of the tube which is reverse or left-hand threadedly attached the tube 10 by means of threads 12 on the surface of tube 10. The portion 13 of tube 10 extending above nut 11 is of slightly larger diameter than the portion 14 below the nut 11 so that rotation of nut 11 moves the unit downwardly along tube section 14 until the nut is free of the groove 12. The purpose of nut 11 will be explained in further detail hereinbelow. The upper end of tube section 13 is threaded 15 interiorly to accommodate attachment to hollow steel tube extending up the grout hole to the surface for connection to a source of grouting material.

At the opposite or bottom end of tube 10 is disposed a retainer ring 16 which is preferably pop-riveted 17 at selected points to the bottom end of tube 10. The strength of pop-rivet 17 can be determined from application to application depending upon the amount of force to be exerted on ring 16 before the rivets 17 are intended to break and release ring 16 from tube 10.

The next tube arrangement concentric with tube 10 is a series of alternating frusto-conical tubes 18 and inverted leather annular caps 19 also of a basicly frusto-conical design. Tubes 18 are constructed to fit snugly at the upper or narrower end about tube 10 with the lower portion of tube 18 flaring slightly to form a secure seat for annular caps 19 with the top of the next lower tube 18, as shown in detail in FIG. 3.

The purpose of caps 19 is to provide a series of downwardly oriented seals with the walls of the grouting hole to prevent the back-flow of grout up the hole as the grout is pumped downwardly through interior tube 10 into the area to be grouted. Caps 19 are slightly flared out-wardly away from the underlying tubes 18 to catch and retain grout passing upwardly along the outside of the grouting tube. Caps 19 are flexible and pliable, and are preferably made of leather, but can be constructed of other material having the qualities and capbilities of leather to accomplish the same objectives. Frusto-conical tubes 18 can be constructed of any material which is drillable, such as ceramic or the like and is preferably rigid.

The uppermost leather cap 19 rests between nut 11 and the upper edge of the uppermost frusto-conical tube 18, as shown in detail in FIG. 3. Both caps 19 and tubes 18 are slideably mounted on tube 10 so that they can be removed easily when retaining ring 16 is removed. Retaining ring 16 when riveted to tube 10 forms the seat for the lower most cap 19, and retains the series of caps 19 and tubes 18 concentric about tube 10.

The third tube in the series is a tubular sheath 20 of preferably uniform longitudinal dimension adapted to fit concentrically around tubes 18 and caps 19. Tube 20 can be constructed of any drillable rigid material, such as ceramic, plastic or the like. The purpose of the sheath 20 is to protect tubes 18 and caps 19 as the grouting tube is lowered into the grout hole to the grouting site. In this manner, the caps 19 are not flared backward by catching on sharp edges or points along the grout hole wall.

At the bottom of the grout hole, the sheath 20 is customarily removed by a blast of air or water through tube 10 against sheath cap 21, which is secured to sheath 20 after it is in place surrounding the inner tubes. Since the sheath material is drillable, it poses no problem in remaining in the grout hole.

After the sheath 20 and sheath cap 21 have been removed from around the tubes, grout material can be injected through the tubes to the grouting area. Caps 19 prevent backflow of the grout up the grout hole, and the tube arrangement functions as a grout packer or plug for the hole. Upon completion of the grouting, the grouting tube of the invention is then withdrawn, leaving the sheath 20 in the hole. Typically, the grouting tube is rotated as it is withdrawn to aid in passing obstructions in the grout hole.

A major advantage in the grouting tube disclosed herein is the arrangement for recovering the mandrel or tube 10, while freeing the remaining component parts if the tube becomes lodged on an obstruction during the withdrawal from the hole. Nut 11 has the widest dimension in circumference of the caps 19 or tubes 18, and it is the first to become entangled with an obstruction as the tube is withdrawn. Since nut 11 is reverse threaded, the normal right-hand revolution of the mandrel or tube 10 with respect to nut 11, releases nut 11 downwardly and applies pressure on retaining ring 16. As soon as the pressure is sufficient to break pop-rivets 17, retaining ring 16 is released, and the continual rotation of tube 10 releases nut 11 from threads 12. Mandrel 10 can then be drawn upwardly and nut 11 passes over section 14 of tube 10 carrying before it caps 19 and tubes 18 to remain in the grout hole. In this way, mandrel tube 10 is recovered, and the remaining material in the hole is drillable so as not to provide any hindrance to future drilling.

Whereas this invention has been described herein with respect to certain preferred forms, it is to be understood that other modifications and embodiments are contemplated as coming within the scope of the appended claims.

We claim:

1. A grouting tube for preventing backflow of grout around said tube during grouting operations, comprising in combination:

an inner tube for carrying grouting material having a reverse threaded portion on the external circumference of said tube a distance from a first end thereof;

nut means disposed about said inner tube having reverse threads for engaging said threaded portion of said inner tube;

annular retaining ring means for mounting on said second end of said inner tube;

mounting means for said annular retaining ring means on said inner tube second end, said mounting means arranged to separate upon application of a predetermined force thereagainst;

a series of alternating multiple annular, flexible cap means and frusto-conical rigid tube means slidingly disposed along the length of said inner tube from said nut means to said annular retaining ring with said tube means spacing said multiple annular cap means predetermined distances apart from each other; and, whereby said cap means prevents backflow of grout around said inner tube external sheath means slidingly disposed about and concentric with said cap means and said frusto-conical rigid tube means whereby said sheath means facilitates the placement of said grouting tube in a grout hole.

2. A grouting tube as set forth in claim 1, wherein said flexible annular cap means are constructed of leather.

3. A grouting tube as set forth in claim 1, wherein said mounting means for said annular retaining ring means comprises a multiplicity of pop rivets.

4. A grouting tube as set forth in claim 1, wherein said inner tube has threads internal of said tube at the first end thereof.

5. A grouting tube as set forth in claim 1, wherein said annular cap means are frusto-conical in shape.

* * * * *